US007547186B2

(12) United States Patent
Schuster et al.

(10) Patent No.: US 7,547,186 B2
(45) Date of Patent: Jun. 16, 2009

(54) NONLINEARLY STACKED LOW NOISE TURBOFAN STATOR

(75) Inventors: William B. Schuster, Phoenix, AZ (US); Karen B. Kontos, Phoenix, AZ (US); Donald S. Weir, Scottsdale, AZ (US); Nick A. Nolcheff, Chandler, AZ (US); John A. Gunaraj, Chandler, AZ (US)

(73) Assignee: Honeywell International Inc., Morristown, NJ (US)

( * ) Notice: Subject to any disclaimer, the term of this patent is extended or adjusted under 35 U.S.C. 154(b) by 603 days.

(21) Appl. No.: 11/166,668

(22) Filed: Jun. 23, 2005

(65) Prior Publication Data

US 2006/0210395 A1 Sep. 21, 2006

Related U.S. Application Data

(60) Provisional application No. 60/614,288, filed on Sep. 28, 2004.

(51) Int. Cl.
*F01D 9/04* (2006.01)

(52) U.S. Cl. ..... 415/119; 415/191; 415/192; 415/208.2; 415/210.1; 415/211.2

(58) Field of Classification Search ..... 415/119, 415/191, 192, 208.1, 208.2, 209.4, 210.1, 415/211.2; 416/189, 223 A, 238
See application file for complete search history.

(56) References Cited

U.S. PATENT DOCUMENTS 4,012,172 A 3/1977 Schwaar et al.
4,131,387 A 12/1978 Kazin et al.
4,685,513 A * 8/1987 Longhouse et al. ..... 416/238
5,249,922 A 10/1993 Sato et al.
5,342,170 A 8/1994 Elvekjaer et al.
5,641,268 A 6/1997 Martin et al.
5,779,443 A 7/1998 Haller et al.
5,848,526 A 12/1998 Hanson
6,195,983 B1 3/2001 Wadia et al.
6,312,219 B1 11/2001 Wood et al.

(Continued)

FOREIGN PATENT DOCUMENTS

EP 1 333 181 A1 8/2003

(Continued)

OTHER PUBLICATIONS

Edmane Envia, "Fan Noise Reduction: An Overview," Feb. 2001, Glenn Research Center, Cleveland, Ohio.

(Continued)

*Primary Examiner*—Christopher Verdier
(74) *Attorney, Agent, or Firm*—Ingrassia Fisher & Lorenz, P.C.

(57) ABSTRACT

A nonlinearly stacked low noise turbofan stator vane having a characteristic curve that is characterized by a nonlinear sweep and a nonlinear lean is provided. The stator is in an axial fan or compressor turbomachinery stage that is comprised of a collection of vanes whose highly three-dimensional shape is selected to reduce rotor-stator and rotor-strut interaction noise while maintaining the aerodynamic and mechanical performance of the vane. The nonlinearly stacked low noise turbofan stator vane reduces noise associated with the fan stage of turbomachinery to improve environmental compatibility

15 Claims, 7 Drawing Sheets

U.S. PATENT DOCUMENTS

| | | | |
|---|---|---|---|
| 6,353,789 | B1 | 3/2002 | Hanson |
| 6,508,630 | B2 | 1/2003 | Liu et al. |
| 6,726,445 | B2 | 4/2004 | Tsuchiya et al. |
| 2004/0091353 | A1 | 5/2004 | Shahpar et al. |

FOREIGN PATENT DOCUMENTS

WO PCT/US2005/035155 9/2005

OTHER PUBLICATIONS

James H. Dittmar, David M. Elliott, E. Brian Fite, "The Noise Of A Forward Swept Fan," Nov. 2003, Glenn Research Center, Cleveland, Ohio.

Lysbeth Lieber, Russ Repp, Donald S. Weir, "Quiet High-Speed Fan," Nov. 1996, AlliedSignal Engines, Phoenix, Arizona.

Donald Weir, "Design and Test of Fan/Nacelle Models Quiet High-Speed Fan," Jul. 2003, Honeywell Engines & Systems, Phoenix, Arizona.

Russ Repp, David Gentile, David Hanson, Srinivas Chunduru, "Design and Test of Fan/Nacelle Models Quiet High-Speed Fan Design," Jul. 2003, Honeywell Engines, Systems and Services.

* cited by examiner

NONLINEARLY STACKED LOW NOISE TURBOFAN STATOR

CROSS-REFERENCE TO RELATED APPLICATIONS

This application claims the benefit of U.S. Provisional Application No. 60/614,288, filed Sep. 28, 2004.

STATEMENT REGARDING FEDERALLY SPONSORED RESEARCH OR DEVELOPMENT

This invention was made with Government support under Contract No. NAS3-01136 awarded by NASA. The Government has certain rights in this invention.

FIELD OF THE INVENTION

The present invention relates to turbofan stators, and more particularly, the present invention relates to nonlinearly shaped turbofan stators for providing improved noise performance.

BACKGROUND OF THE INVENTION

Gas turbine engines, such as those used in aerospace applications, often have a combination of a rotor assembly and stator assembly positioned in the forward section of the engine. It is known that the movement of air, propelled by the rotor assembly across the stator assembly, may generate undesirable noise. It is generally desired to design engine components so as to minimize this potential noise generation.

Within the limited space constraints in the rotor-stator-strut system of a turbine engine, the discrete tone noise generated by rotor-stator and rotor-strut interactions should preferably be minimized by the three-dimensional shaping of the blades, while maintaining aerodynamic and mechanical performance of the system. The possible three-dimensional shapes of the rotor blades, stator vanes, and struts may be constrained by a variety of design objectives and practical considerations. In regards to the stator vane, these constraints may include the limited overall length of the rotor-stator-strut system, aerodynamic performance requirements at a variety of operating conditions, mechanical robustness, and manufacturing and assembly constraints.

Prior techniques of addressing the above-noted constraints include combinations of straight sweeping of the stator vane by linear displacement of the airfoil section so that the tip of the stator vane is displaced aft, and straight leaning of the stator vane in the direction of rotor rotation by linear displacement of the airfoil section. Straight leaning of the stator vane in the direction of rotor rotation can provide reductions in tone noise but is usually associated with aerodynamic losses in the hub region, where it is aerodynamically preferable to lean the stator vane in the direction opposite to rotor rotation. Thus it would be desired to develop further improved stator vane designs that achieve a noise reduction but without suffering from unacceptable aerodynamic losses.

Hence there is an ongoing need to provide improved stator vanes that have low noise characteristics. It would be desired to provide a stator vane design that fits within the structural limitations of the rotor-stator system of a gas turbine engine. It would further be desired that the stator vane provide good aerodynamic performance while maintaining good acoustic characteristics. The present invention addresses one or more of these needs.

SUMMARY OF THE INVENTION

The present invention provides a nonlinearly stacked low noise turbofan stator. In one embodiment, and by way of example only, there is provided a stator vane for use in a gas turbine engine. The stator vane has a characteristic curve beginning at a hub point and terminating at a shroud point. The characteristic curve is characterized by a nonlinear sweep curve in the axial-radial plane and a nonlinear lean curve in the radial-circumferential plane. The nonlinear sweep curve begins at the hub point and terminates at the shroud point such that the shroud point is positioned axially aft of the hub point in the axial-radial plane. The nonlinear lean curve begins at the hub point and terminates at the shroud point such that the shroud point is positioned circumferentially in a positive direction relative to the hub point in the radial-circumferential plane.

In a further embodiment, still by way of example, there is provided a low noise stator vane for use in a gas turbine engine positioned downstream of a rotor assembly. The vane includes: a leading edge which defines a leading edge curve having a leading edge sweep and a leading edge lean, the leading edge sweep and the leading edge lean each being nonlinear curves; and a trailing edge which defines a trailing edge curve having a trailing edge sweep and a trailing edge lean, the trailing edge sweep and the trailing edge lean each being nonlinear curves. The leading edge curve and the trailing edge curve need not be the same.

In still a further embodiment, and still by way of example, there is provided a method for designing a characteristic curve for a low noise stator vane. The method includes the steps of: setting a hub point and a shroud point; selecting at least three additional variable points such that the hub point, shroud point, and variable points lie in the same plane; fitting a nonlinear curve that begins at the hub point, passes through the variable points, and terminates at the shroud point; repeating the steps of selecting variable points and fitting a nonlinear curve so as to create a set of nonlinear curves; and simulating the performance of each curve for acoustic performance.

Other independent features and advantages of the nonlinearly stacked low noise turbofan stator will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention. Reference will now be made in detail to exemplary embodiments of the invention, examples of which are illustrated in the accompanying drawings. Wherever possible, the same reference numbers will be used throughout the drawings to refer to the same or like parts.

In the preferred embodiment of the low noise stator, a nonlinear stacking of the stator vane is used in which the vane is leaned in the direction opposite rotor rotation in the hub region and in the direction of rotor rotation in the shroud region. In order to offset the acoustic penalty associated with leaning the vane in the direction opposite rotor rotation near the hub, the vane is swept aft more aggressively than a linearly swept vane near the hub. However, the higher vane sweep angle near the hub quickly recesses the vane in an aft direction and thus results in a reduced possible sweep angle nearer the shroud, which is generally acoustically disadvantageous. The reduced sweep near the shroud is counteracted by leaning the vane in the direction of rotor rotation in the shroud region more aggressively than a linearly leaned vane. Between the hub and tip region, the vane lean and sweep is smoothly transitioned by prescribing the displacement of the airfoil as a function of radius.

Figure 1:
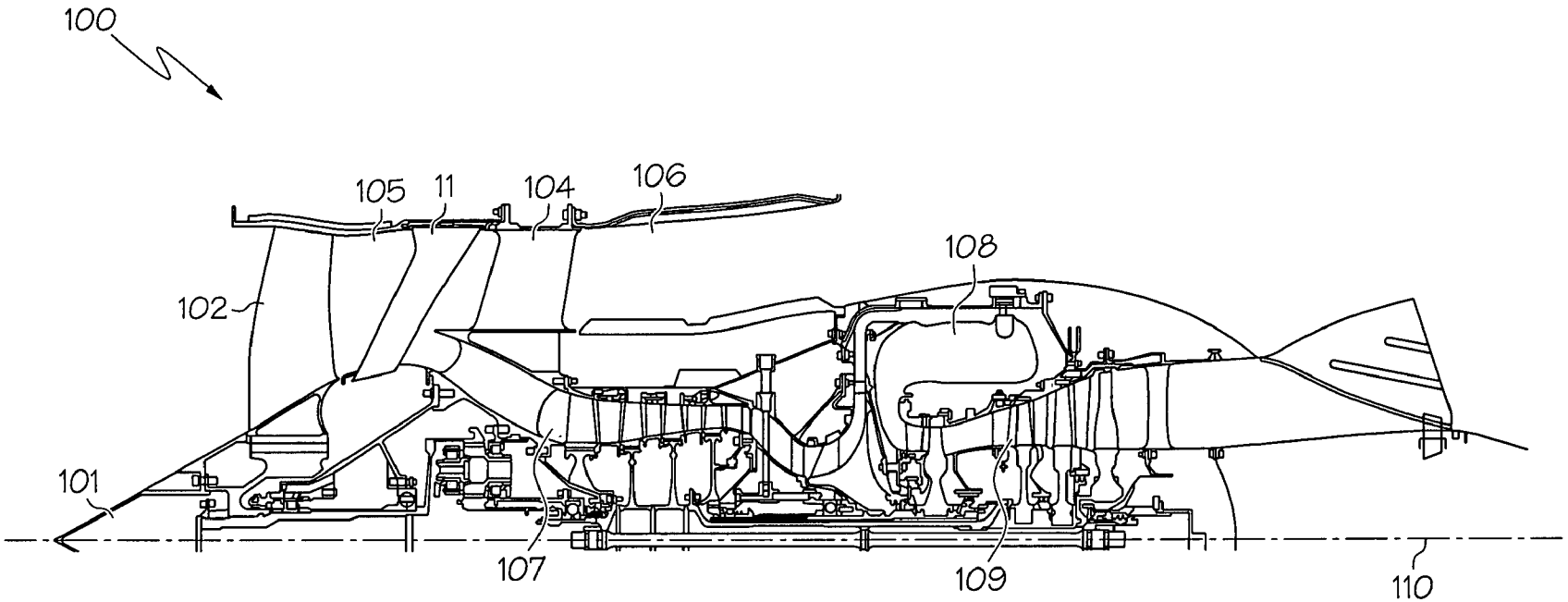
FIG. 1 is a partial cross section of a gas turbine engine having a stator assembly that may use a vane according to an embodiment of the present invention.

Referring now to FIG. 1 there is shown a partial cross sectional view of an exemplary gas turbine engine 100. A forward portion of the engine 100 includes nose cone 101, rotor 102, stator vane 11, strut 104, and cowling 105. Rotor 102 is part of a rotor assembly which rotates around axis 110 and which blows fan air through two sections of the engine, the fan air section 106 and the compressor section 107. Air passing through compressor section 107 proceeds through a combustion section 108 and turbine section 109. Stator vane 11 is also part of a larger stator assembly also radially positioned around axis 110. The stator assembly is stationary during operation of a turbine engine. An individual stator vane 11, sometimes referred to herein as a vane 11, has a preferred shape which is not fully shown in FIG. 1.

Figure 2:
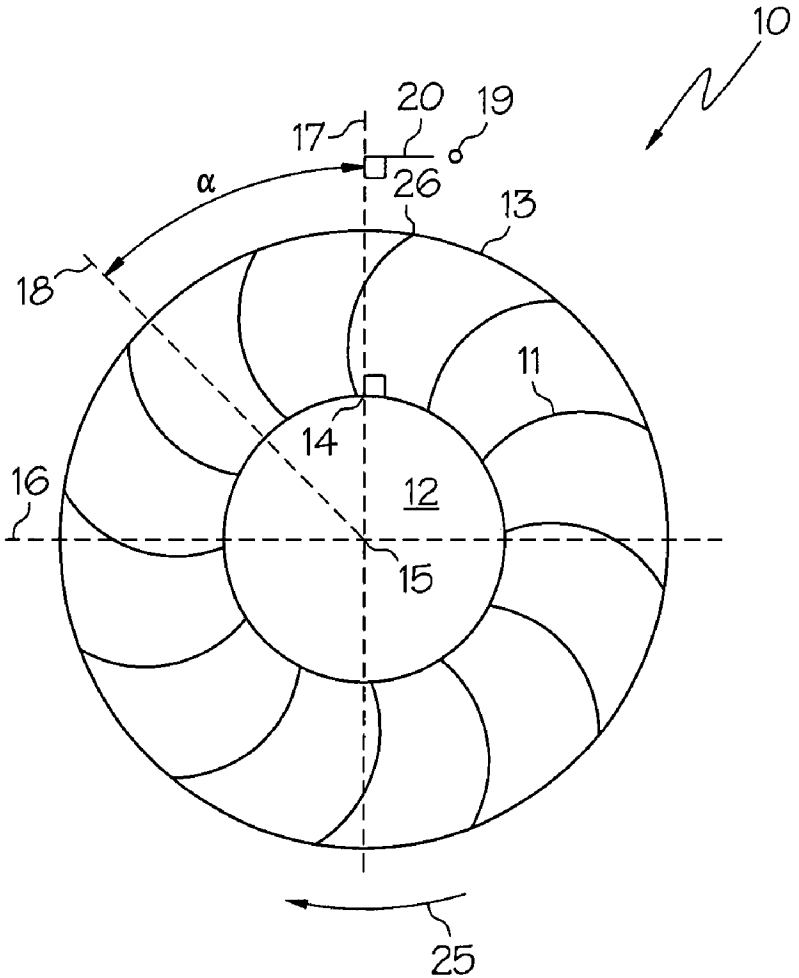
FIG. 2 is front view of a stator assembly according to an embodiment of the present invention.

In FIG. 2 there is shown a simplified front view of a stator assembly 10 in a gas turbine engine according to an embodiment of the present invention. Vanes 11 are disposed so as to extend radially outwardly from hub 12 until reaching shroud 13. As will be understood by those skilled in the art, stator assembly 10 is positioned aft (relative to the direction of airflow) from a rotor section. The stator assembly 10 includes a plurality of vanes 11, the number of which may vary depending on particular engine requirements.

Vanes 11 are represented in simplified form in FIG. 2 by a single curved line; however, as will be appreciated by those skilled in the art vanes 11, are actually three dimensional structures. Vane 11 is an airfoil having a leading edge 21 and a trailing edge 22 (shown in FIG. 3). Vane 11 also has a pressure side and a suction side (not shown), each of which is also curved. The characteristic curve representing vane 11 in FIG. 2 may correspond to a physical curve on the vane structure such as a vane leading edge 21 or trailing edge 22. Alternatively, the characteristic curve of vane 11 may correspond to a nonphysical curve developed mathematically such as a center of gravity curve or chord midpoint curve. When a vane 11 is represented by a curve, the vane curve begins at hub point 14 and extends to shroud point 26. The hub point is the point where the curve contacts hub 12, and the shroud point is the point where the curve contacts shroud 13. It is noted that vanes 11 of the preferred embodiment of the present invention are characterized by having a nonlinear characteristic curve.

The convention that will be followed in describing space related to a vane structure is now described. A Cartesian format is preferably used in which axis 110 of FIG. 1 and lines 16 and 17 of FIG. 2 represent the axes for the three dimensions. Axial position thus refers to a position on a line corresponding to the imaginary axis 110 or axial line of the stator assembly or engine as shown in FIG. 1. Typically a stator assembly is positioned symmetrically around such an axial line 110. The radial position refers to position on a radial line 17, shown in FIGS. 2 and 3, normal to the axial line 110. Radial line 17 extends from the center 15 of hub 12 through the hub point 14 of an individual vane 11. The term circumferential position (or tangential position) refers to the position on line 16 which is normal to radial line 17. Circumferential position may alternatively be given in angular format. Positions and individual points may further be described as having a positive or negative position with respect to radial line 17. Thus, for example, radial line 18 in FIG. 2 is positioned at angle $\alpha$ with respect to radial line 17, and radial line 18 is negatively positioned with respect to radial line 17. Alternatively, using the Cartesian convention, point 19 is positioned positively a distance 20 normal to radial line 17. The above convention may also describe two dimensional planes such as the axial-radial plane, the radial-circumferential plane, and the axial-circumferential plane. A position may also be described with respect to the direction of rotor rotation. For purposes of this description, rotor rotation is clockwise as shown by arrow 25 in FIG. 2. This rotor rotation is for descriptive purposes only, and it will be understood that the principles of the invention apply also to other rotor rotations.

Vane lean refers to the position of vane 11 in the radial-circumferential plane. Lean may further be described with respect to a reference such as radial line 17. Similarly, vane sweep refers to the position of vane 11 in the radial-axial plane, and vane sweep may also be described with respect to a reference such as radial line 17. In the embodiments of the present invention, vane sweep and vane lean each describe nonlinear curves. Further, the degree of curvature at given positions of the overall curve (of either vane sweep or vane lean) may be described by referencing the slope of the curve at a tangential point on the curve. Thus, for example, in FIG. 2 the slope of the characteristic curve for vane 11 at hub point 14 is negatively sloped, and the slope at shroud point 26 is positively sloped (with respect to radial line 17). The characteristic curve for vane 11 in FIG. 2 may further be described as having a slope that transitions from negatively sloped to positively sloped as tangential points on the curve extend radially outwardly from hub point 14 to shroud point 26. Further, to describe vane lean with respect to rotor rotation, vane 11 leans against rotor rotation near the hub and leans with rotor rotation near the shroud.

Figure 3:
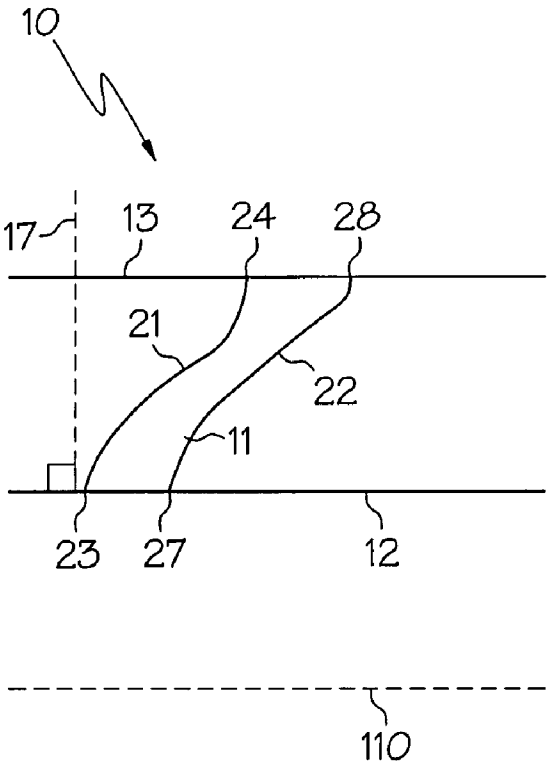
FIG. 3 is a side cross sectional view of a stator vane according to an embodiment of the present invention.

Referring now to FIG. 3 there is shown a side view of a portion of the stator assembly 10 of FIG. 2 according to an embodiment of the present invention. Vane 11 is here represented by its leading edge 21 and trailing edge 22. Each of leading edge 21 and trailing edge 22 is also described by a characteristic curve for vane 11. Leading edge 21 and trailing edge 22 are again characterized as nonlinear curves which may also vary. The leading edge curve 21 and trailing edge curve 22 need not be the same. Leading edge curve 21 begins at leading edge hub point 23 and extends to leading edge shroud point 24. Trailing edge curve 22 begins at trailing edge hub point 27 and extends to trailing edge shroud point 28. FIG. 3 further illustrates that vane 11, viewed in side profile, may be characterized by having a sweep relative to radial line 17.

Figure 4:
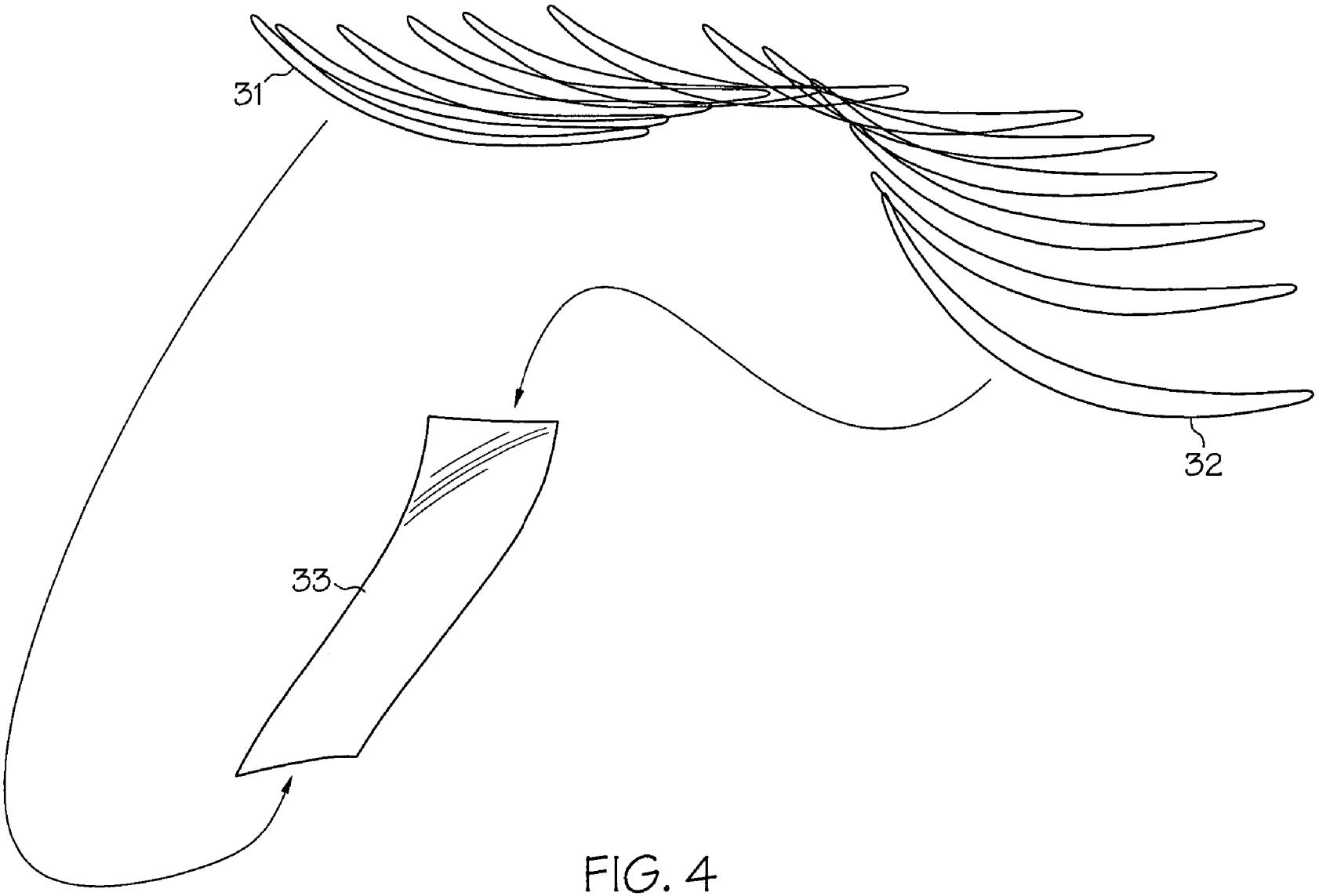
FIG. 4 is multiple sectional view of a stator vane according to an embodiment of the present invention.

One way to illustrate a vane's sweep and lean is to define the vane by a series of radially spaced cross sections. These cross sections may be "stacked" (positioned) relative to one another in different ways. The cross sections could be stacked all on top of one another, or shifted. The relative position of each cross section thus indicates how the vane is swept and leaned. Referring now to FIG. 4 there is shown a multiple sectional view of vane 11. The complex curvature of vane 11 may be described and illustrated by dividing vane 11 into a number of sections. Each section in FIG. 4 represents the intersection of vane 11 with an axial-circumferential plane normal to the radial line 17 shown in FIG. 2. The differing sections represent the intersection with the planes at different radial positions. The illustrated sections begin with hub section 31, and the sections proceed radially outwardly, until finishing with shroud section 32. Hub section 31 and shroud section 32 are linked by arrow to vane profile 33 to show the position of each section on vane 11. Hub section 31 thus shows the planar section of vane 11 at radial points proximate to hub 12, and shroud section 32 shows the planar section of vane 11 proximate to shroud 13. FIG. 4 thus provides a graphical illustration of the complex curvature of vane 11. Sweep and lean are changing at each radial position.

Figure 6:
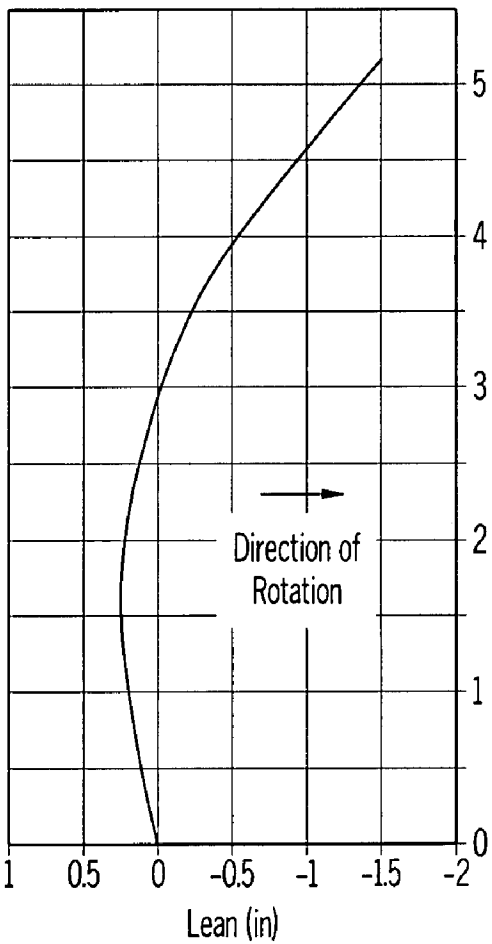
FIG. 6 is a graphical illustration of stator vane lean according to an embodiment of the present invention.
Figure 5:
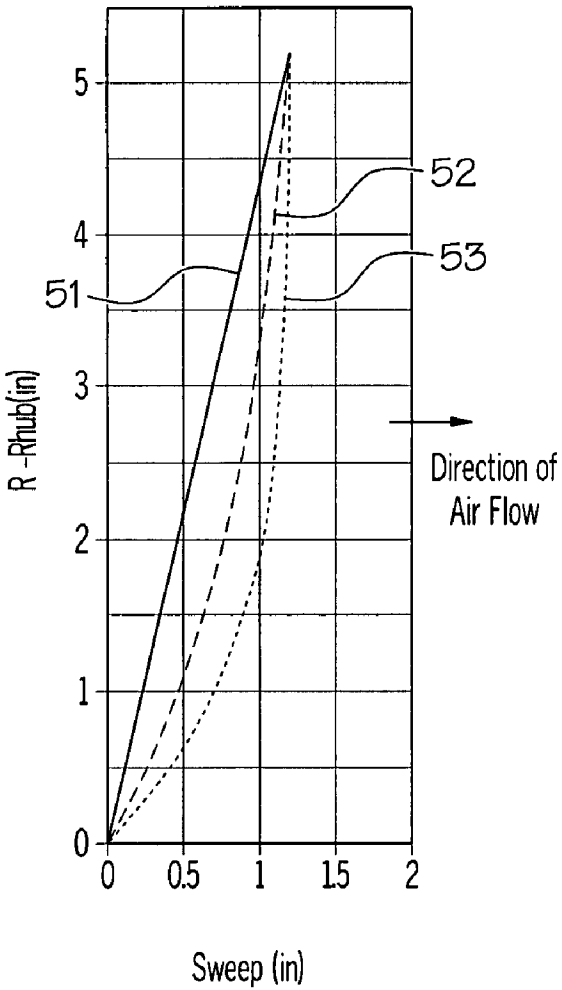
FIG. 5 is a graphical illustration of stator vane sweep according to an embodiment of the present invention.

Referring now to FIG. 5 and FIG. 6 an exemplary sweep and lean of vane 11 are represented in graphical form. Again, the curves shown in FIGS. 5 and 6 may correspond to any characteristic curve of a vane. In both FIGS. 5 and 6, the y-axis represents radial distance beginning at hub point 14 and moving radially outwardly toward the shroud. Radial measurements are given in inches. In FIG. 5, the x-axis represents a measurement of axial sweep, for example in inches, measured axially from radial line 17. FIG. 5 illustrates a linear slope 51 (provided for comparison purposes), a first sweep curve 52 and a second sweep curve 53. Both sweep curves 52 and 53 are swept "more aggressively" than the linear slope 51, meaning that points in the sweep curves 52 and 53 fall below the linear slope 51. In FIG. 6, the x-axis represents a measurement of lean, again in inches, also measured normal from radial line 17 (using the Cartesian convention). FIG. 6 illustrates the lean as having an initial negative slope and then transitioning to a positive slope. Also, FIG. 6 illustrates the lean as initially going against the direction of rotor rotation and then in the direction of rotor rotation, moving radially outward. FIGS. 5 and 6 are thus useful in showing the relationship between sweep and lean in a low noise turbofan stator having nonlinear curvature. For a given radial position, the sweep and lean position can be determined in each figure. The specific relationship between these curves is described further herein.

An example of how a stator vane is designed so as to be defined by a nonlinear characteristic curve is now described. This process of defining the characteristic curve can be but a first step in a general design of experiments utilized to optimize stator vane design. A design of experiments, as known by those skilled in the art, refers to a method wherein a set of possible designs is created. In an embodiment of this process, the set of possible designs is a set of distinct characteristic curves. Each characteristic curve in the set is then tested, as by simulator software, in order to model the performance of that design. From that modeling, an optimum or preferred design (or designs) can be selected.

Figure 9:
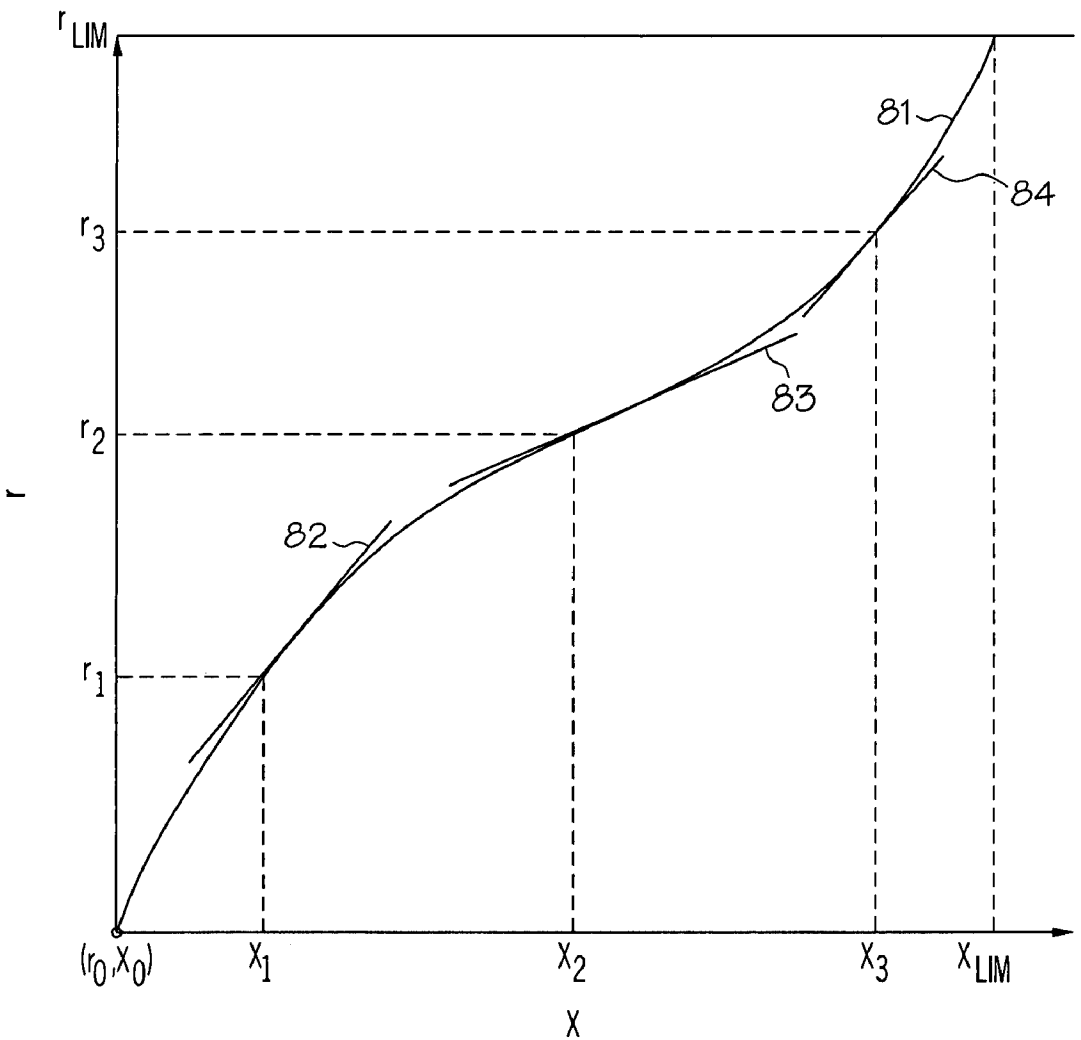
FIG. 9 is a graphical illustration of steps in a method of constructing a nonlinear curve to represent a stator vane characteristic according to an embodiment of the present invention.

Referring now to FIG. 9 there is shown a stator vane sweep curve 81. Sweep curve 81 represents some characteristic of vane 11. As described before, sweep curve 81 may correspond to a curve on the vane structure such as a vane leading edge 21 or trailing edge 22. Alternatively, sweep curve 81 may correspond to a calculated curve such as a center of gravity curve or chord midpoint curve. In the turbine engine design process, aerodynamic parameters and mechanical parameters are frequently modeled and simulated through center of gravity data. Thus it is generally preferred, in one embodiment, to construct sweep curve 81 as a center of gravity curve so as to allow easy transition and use of data.

As shown in FIG. 9, the position of a point on sweep curve 81 can be described with respect to a function, $r=f(x)$ where r defines the radial position relative to a given x location. In the design process, the (r, x) positions for the curve 81 are known at a beginning point $(r_0, x_0)$ and an ending point $(r_{LIM}, x_{LIM})$. These two points may be defined by physical parameters of the engine. $X_0$ then represents the forward position that a stator vane may be positioned, and $X_{LIM}$ corresponds to the most aftward position where a stator vane may be positioned. Likewise $r_0$ and $r_{LIM}$ are defined by the lower and upper limits allowed for the stator assembly. While it is perhaps not necessary to extend $x_{LIM}$ to the most aftward possible position, it is preferred to do this. An acoustic benefit is generally obtained by increasing the distance between the rotor assembly and stator assembly.

The design process, in the described embodiment, then selects the positions for an additional three points $(r_1, x_1)$, $(r_2, x_2)$, and $(r_3, x_3)$. A continuous, nonlinear curve is then fitted to these points. A fourth order polynomial is one preferred function that may be used to fit the nonlinear curve. A fourth order polynomial is preferred in that it is not overly unwieldy to manipulate mathematically and it provides a good degree of curvature. Other nonlinear functions, including higher order polynomials, may be used to fix the nonlinear curve.

In the same manner that sweep curve 81 was defined, an entire set of nonlinear curves are defined. This set of curves is obtained by progressively changing the position of each of points $(r_1, x_1)$, $(r_2, x_2)$, and $(r_3, x_3)$, and then refixing the curve. A designer, knowing a potential spatial range that sweep curve 81 can occupy, can vary the points $(r_1, x_1)$, $(r_2, x_2)$, and $(r_3, x_3)$ within that space. Doing so generates a family of curves that progressively cover the allowed spatial range.

FIG. 9 further illustrates tangential lines 82, 83, and 84. These lines are tangent to curve 81 at each of points $(r_1, x_1)$, $(r_2, x_2)$, and $(r_3, x_3)$. Thus, in one embodiment, it may be preferred to set a curve slope at a first position, second position, and third position. The curve may then be fitted to include tangential slopes matching these set curves. Tangential lines 82, 83, and 84 also illustrate how a degree of curvature may be described by the slope of a tangent line for a chosen point.

In a method similar to the one just described for obtaining a nonlinear curve to represent a sweep curve 81, a lean curve may also be defined. For example, a hub point 14 and shroud point 26 may be defined. Or, if desired, the shroud point 26 may itself be varied during the method. Other points necessary to mathematically define the curve are also selected. Using a continuous, nonlinear function (such as a fourth order polynomial) a curve is then fixed that begins with hub point, include the selected points, and terminates with shroud point. And, again, a family of curves is obtained by systematically varying the positions of the selected points and refixing a curve to include them.

Now having established a family of sweep curves and a family of lean curves, the performance of these curves is determined. The curves for the sweep and the curves for the lean may themselves be combined, if desired, so as to define a three dimensional curve. This three dimensional curve can then be used to model the performance of the stator vane it represents. In other embodiments, the sweep and lean curves may be modeled separately. The performance may be simulated, for example, with respect to acoustic performance, aerodynamic performance, and mechanical performance. The simulation develops data for each design. That data is then evaluated in order to select the preferred design or set of designs. The design of experiments approach is useful where, as with stator vane designs, a set of positional points—$(r_1, x_1)$, $(r_2, x_2)$, and $(r_3, x_3)$—can be systematically varied in order to create a group of different designs.

During the modeling step, it is preferred to model acoustic, aerodynamic, and mechanical characteristics of the vane design. Programs that model these characteristics are known in the art. Acoustic simulation software that may be used is a NASA developed program known under the acronym TFANS. A typical mechanical simulation is known under the acronym ANSYS, and an aerodynamic simulation program simulator is known under the acronym AP NASA and ADPAC. Other simulation programs may be used.

Figure 10:
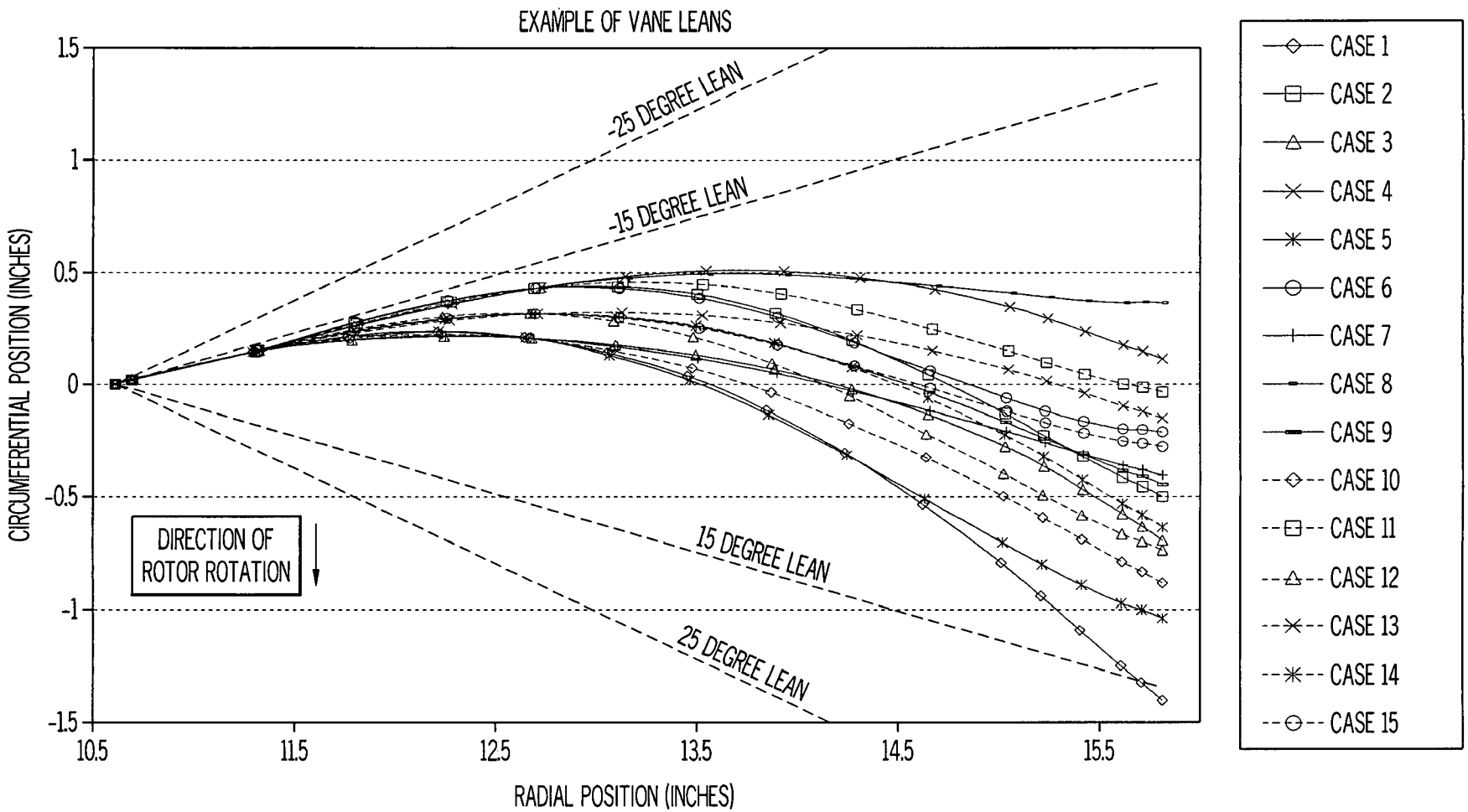
FIG. 10 is a graphical illustration of a family of nonlinear curves representing vane lean according to an embodiment of the present invention.

A graphical representation of one aspect of a design of experiments is shown in FIG. 10. FIG. 10 illustrates a variety of curves drawn to represent vane lean. The x-axis in FIG. 10 corresponds to radial position measured in inches, and the y-axis corresponds to circumferential position measured in inches. Linear leans at −25, −15, +15, and +25 degrees are shown in dashed lines. While none of the curves was created with linear lean, these lines are included as a reference. As shown in the embodiment of FIG. 10, the family of lean curves for the stator vane is preferably positioned within a cone between about −20 to about +20 degrees, relative to a radial line, beginning from the hub position. Alternatively, a lean curve may be positioned within a cone of about −30 to about +30 degrees relative to the radial line beginning at the hub point.

Figure 8:
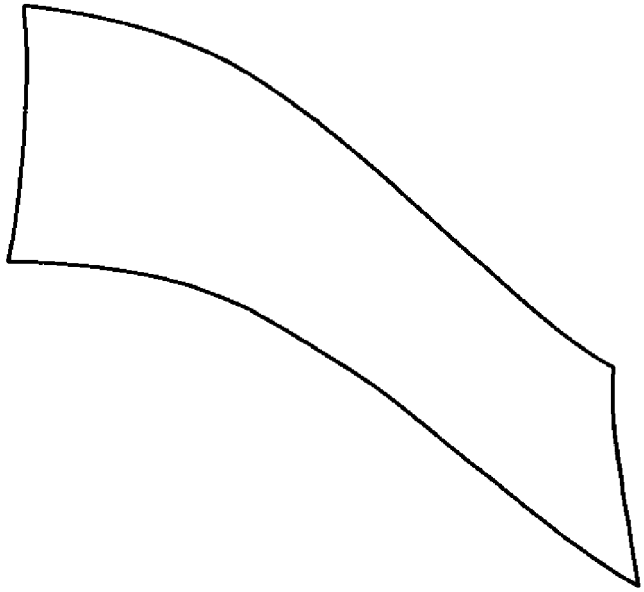
FIG. 8 is a side profile view of a stator vane according to an embodiment of the present invention.
Figure 7:
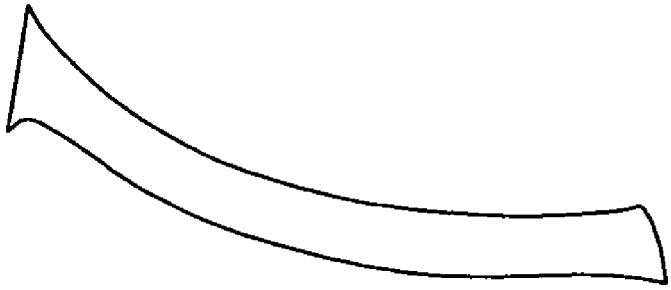
FIG. 7 is a front profile view of a stator vane according to an embodiment of the present invention.

Using the methods above-described, the inventors developed a stator vane having the general shape shown in FIGS. 7 and 8. FIG. 7 shows a front profile of the exemplary stator vane, and FIG. 8 shows a side profile. It will be appreciated that a given stator vane design depends on a number of criteria, beyond acoustics. Engine dimensions and engine specifications, for example, impact the final shape of a stator vane. Nevertheless, there may be described a general shape for a stator vane which incorporates acoustic advantages.

The vane lean, best shown in FIG. 7, begins with a lean in the direction against rotor rotation (a negatively sloped lean). This initial lean in the direction against rotor rotation, in approximately the first third of the lean curve as measured by the overall curve length starting from the hub point, provides an aerodynamic performance advantage; however, it also has a less than optimal acoustic performance. In order to offset the acoustic penalty of the initial lean, the vane is more aggressively swept aft in its initial portion, as shown in FIG. 8. It was found that an aft sweep provides an acoustic benefit that partially offsets the acoustic penalty associated with the vane lean. A similar relationship between lean and sweep in the portion of the curve close to the hub is also illustrated in the curve relationships in FIGS. 5 and 6. There, the lean curve begins negatively, so the sweep curve is most aggressive (has the lowest slope) in the first portion (hub area) of the curve, as seen for example in curves 52 and 53.

Referring again to FIGS. 7 and 8, in the upper (outwardly radial) sections of the vane (approximately the final third portion of the curve as measured by curve length starting from the hub), the vane is less aggressively swept aftward than in the hub area. The slope of vane sweep is higher in the final third than in the first third of the sweep curve. The smaller degree of sweep close to the shroud is offset by increasing the amount of lean in that area. FIG. 7 illustrates a sharp positive lean curve in the upper third of the vane. This is due in part to space limitations. Shifting the allowable sweep more aggressively aft in the hub area, necessitates sweeping the vane less in the latter area. Thus, both FIGS. 7 and 8, and well as FIGS. 5 and 6, illustrate the principle that sweep and lean are good together. However, if constraints dictate that a design can't have as much lean, you can offset that by creating more sweep. This is what happens in the hub area. Closer to the shroud, where aggressive lean is possible, the design doesn't need as much sweep.

In one aspect of a characteristic vane curve, a nonlinear lean curve slopes negatively (against the direction of rotor rotation) near the hub point and slopes positively (with the direction of rotor rotation) near the shroud point.

In another aspect, a nonlinear lean curve, near the shroud point, slopes at an angle that is less than the inverse of the slope near the hub point. This refers to the combination of more aggressive sweep with a less aggressive lean near the hub point. Near the hub point here means, approximately, the first third, by overall curve length for each of the lean curve and sweep curve, beginning from the hub point.

In another aspect the nonlinear sweep curve slopes at a lower angle, relative to the axis, near the hub point than near the shroud point. In a further aspect, the nonlinear sweep curve has a positive slope at all points on the curve. In still a further aspect, the sweep curve lies below the line between the hub point and the shroud point in the first third of the curve arc length measured from the hub point.

In a further aspect, the shroud point may be positioned at least 1 inch aft of the hub point in the axial direction. The relative position of the shroud point swept aft of the hub point may further be characterized by a straight line connecting the two points where the straight line defines a sweep of between about 20° and about 30°. Additionally, the shroud point may be positioned at least 1 inch circumferentially in the direction of engine rotation relative to the hub point.

Other features may be present, though not required, in the vane geometry. These possible features include vane shapes having twist, tapering, and/or staggering. The nonlinearly stacked low noise stator described herein is also applicable to turbomachinery that employs axial stages, such as turbofans, turboshafts, turbojets, and auxiliary power units.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A stator vane for use in a gas turbine engine, the vane having a curved shape comprising:

a hub point;

a shroud point; and a curved portion connecting the hub point and the shroud point, the curved portion described by a (i) nonlinear sweep curve that begins at the hub point and terminates at the shroud point, the shroud point displaced axially aft relative to the hub point in the sweep curve and (ii) a nonlinear lean curve that begins at the hub point and terminates at the shroud point, the shroud point displaced circumferentially relative to the hub point in the lean curve, wherein the nonlinear sweep curve and the nonlinear lean curve are each characterized by fourth order or higher polynomial equations.

2. The stator vane according to claim 1 wherein the curved shape defines a leading edge of the vane, a trailing edge of the vane, a center of gravity curve of the vane, or a mid chord curve of the vane.

3. The stator vane according to claim 1 wherein the gas turbine engine defines a direction of rotor rotation, and wherein the nonlinear lean curve slopes against the direction of rotor rotation near the hub point and slopes with the direction of rotor rotation near the shroud point.

4. The stator vane according to claim 1 wherein the curved portion has a radial length beginning at the hub point and terminating at the shroud point, and wherein the nonlinear lean curve, within the first one third radial length from the hub point, has a slope that is less than the negative of the slope of the lean curve where the slopes are taken at the same radial position.

5. The stator vane according to claim 1 wherein the gas turbine engine defines a direction of rotor rotation, and wherein the nonlinear lean curve slopes against the direction of rotor rotation near the hub point and wherein the nonlinear sweep curve slopes at a lower angle, near the hub point than near the shroud point.

6. The stator vane according to claim 1 wherein the nonlinear lean curve lies within a cone of −30 and +30 degree angles relative to a radial line beginning from the hub point of the lean curve.

7. The stator vane according to claim 1 wherein the shroud point is positioned at least 1 inch aft of the hub point in the axial direction.

8. The stator vane according to claim 1 wherein the shroud point is positioned at least 1 inch circumferentially positively relative to the hub point.

9. The stator vane according to claim 1 wherein the nonlinear sweep curve has a positive slope at all points on the curve.

10. The stator vane according to claim 1 wherein the nonlinear sweep curve lies below the line connecting the hub point and the shroud point in the first third of the curve arc length measured from the hub point.

11. A low noise stator vane for use in a gas turbine engine positioned downstream of a rotor assembly, the vane comprising:

a leading edge which defines a leading edge curve having a leading edge sweep and a leading edge lean, the leading edge sweep and the leading edge lean each being nonlinear curves; and a trailing edge which defines a trailing edge curve having a trailing edge sweep and a trailing edge lean, the trailing edge sweep and the trailing edge lean each being nonlinear curves, wherein the leading edge sweep and the leading edge lean are each characterized by fourth order or higher polynomial equations, which may be different.

12. The stator vane according to claim 11 wherein the leading edge sweep begins at a hub point and terminates at a shroud point such that the shroud point is positioned axially aft of the hub point.

13. The stator vane according to claim 12 wherein the leading edge lean begins at the hub point and terminates at the shroud point such that the shroud point is positioned circumferentially in a positive direction relative to the hub point.

14. The stator vane according to claim 11 wherein the leading edge lean lies within a cone of about −30 and about +30 degree angles relative to a radial line beginning from a hub point of the leading edge lean curve.

15. The stator vane according to claim 11 wherein the leading edge lean transitions from a negative tangential slope to a positive tangential slope as a tangent point on the leading edge lean curve moves radially outwardly from a hub point of the leading edge lean curve to a shroud point.

* * * * *